US007909532B2

(12) United States Patent
Johnson et al.

(10) Patent No.: US 7,909,532 B2
(45) Date of Patent: Mar. 22, 2011

(54) MOUNTING APPARATUS FOR INFRARED HEATING DEVICE

(76) Inventors: Clint Johnson, Dousman, WI (US); Steve Gapp, Dousman, WI (US)

( * ) Notice: Subject to any disclaimer, the term of this patent is extended or adjusted under 35 U.S.C. 154(b) by 231 days.

(21) Appl. No.: 12/197,242

(22) Filed: Aug. 23, 2008

(65) Prior Publication Data

US 2010/0047008 A1 Feb. 25, 2010

(51) Int. Cl.
*E01C 23/14* (2006.01)

(52) U.S. Cl. ..... 404/95; 404/83; 404/85

(58) Field of Classification Search ..... 404/77, 404/79, 85, 86, 95, 83
See application file for complete search history.

(56) References Cited

U.S. PATENT DOCUMENTS 3,275,342 A * 9/1966 Layton ..... 280/460.1
3,374,717 A * 3/1968 Reynolds, Jr. ..... 404/114
4,072,435 A 2/1978 Coho
4,423,980 A 1/1984 Warnock
4,511,284 A 4/1985 Sterner
4,749,303 A 6/1988 Keizer et al.
5,131,788 A 7/1992 Hulicsko
5,419,654 A 5/1995 Kleiger
5,860,764 A * 1/1999 Roberts ..... 404/93
6,742,959 B2 * 6/2004 Strassman ..... 404/95
6,998,010 B2 * 2/2006 Wiley ..... 156/309.6
7,252,455 B2 * 8/2007 Larsen ..... 404/95
7,316,520 B2 1/2008 Grubba
2002/0090268 A1 * 7/2002 Haller ..... 405/128.85
2004/0057794 A1 * 3/2004 Corcoran ..... 404/79
2007/0071552 A1 * 3/2007 Velsor ..... 404/77
2008/0279629 A1 * 11/2008 Nasby ..... 404/118

* cited by examiner

*Primary Examiner* — Raymond W Addie
(74) *Attorney, Agent, or Firm* — Absolute Technology Law Group, LLC

(57) ABSTRACT

A mounting apparatus for an infrared heating device comprising a platform attached to a frame of an infrared heating chamber, at least one telescoping member affixed to said platform, and at least one attachment component which fixedly attaches said at least one telescoping members to said truck frame and allows said support bar to be moved along a horizontal axis at varying positions from the back of a vehicle.

10 Claims, 5 Drawing Sheets

MOUNTING APPARATUS FOR INFRARED HEATING DEVICE

FIELD OF INVENTION

This invention relates generally to the field of vehicles used for road repair, and in particular to an apparatus to improve the functionality of vehicles used in infrared asphalt repair.

BACKGROUND

Figure 1A:
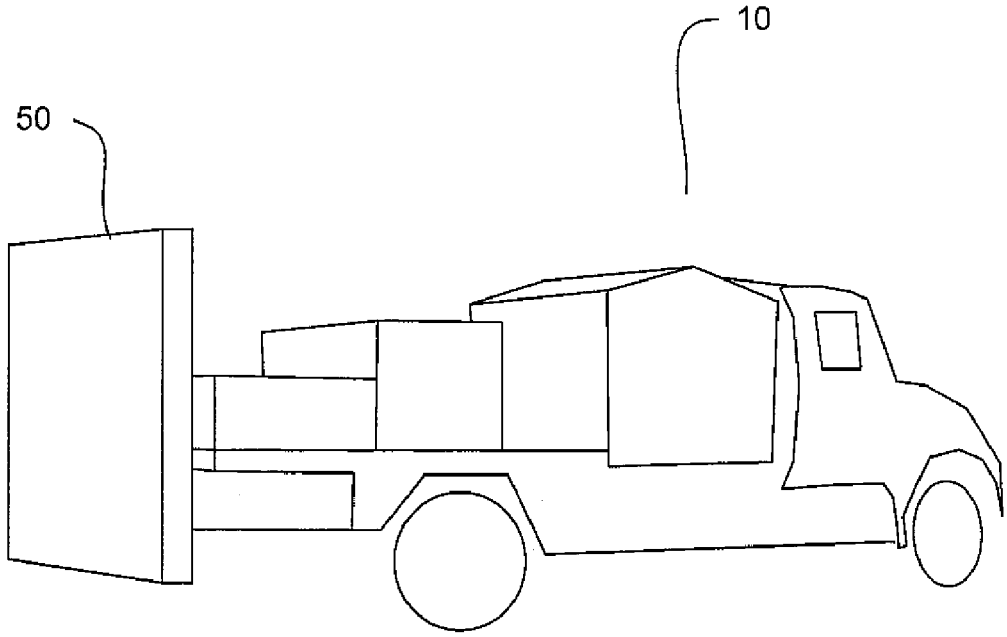
FIG. 1*a* shows an embodiment of a road repair vehicle with an infrared heating chamber in an upright position.

Asphalt is a material commonly used in conjunction with other materials for repairing roads, runways, driveways and other ground surfaces. Asphalt is a sticky, generally black and highly viscous liquid or semi-solid that is made from the residue of the distillation process used for crude oils, particularly petroleum. Asphalt may also be referred to as bitumen.

Asphalt is in particular used as a glue or binding substance for various types of aggregate particles. Asphalt is typically stored and transported at temperatures around 150 degrees Celsius (300° F.). It is important to maintain the liquidity of asphalt so that it can be evenly distributed on ground surfaces. Sometimes diesel oil or kerosene is combined with asphalt for shipping, and later separated. As a general rule, it takes approximately 8-12 minutes to properly heat and soften the asphalt. Heating time may vary depending on wind and temperature, moisture and humidity, and the composition of the asphalt material.

Once the temperature of the asphalt has exceeded 425 degrees, the rate of oxidation (evaporation of oils) is accelerated. At approximately 500 degrees, the asphalt actually starts to burn rendering it useless and guaranteeing the failure of the repair. Simply raking off the burnt asphalt will not remedy the situation because a portion of the existing heated asphalt must be left untouched so that the restoration can be rolled into a heated existing surface.

Methods for effectuating asphalt repairs and trucks with on-board heating systems for maintaining the liquidity of asphalt and effectively distributing it on ground surfaces are well known in the art.

U.S. Pat. No. 4,198,177, issued Apr. 15, 1980, teaches a "Method And Apparatus For Repair Of Asphalt Surfaces" and discloses a system for repairing asphalt surfaces which includes an emulsion tank, air pressure source, emulsion heating source, pneumatic tools, and a vehicle having a fluid-cooled engine and a utility body for containing asphalt repairing material. U.S. Pat. No. 4,423,980, issued Jan. 3, 1984, discloses a further improvement of an irremovably mounted asphalt tank for heating asphalt to a usable temperature. Certain of the pneumatic tools may be selectively driven by compressed air held in a storage tank to selectively heat and repair a damaged asphalt surface.

U.S. Pat. No. 5,419,654, issued May 30, 1995, discloses a vehicle with a telescoping tube assembly extendable between a maximum and a minimum overall length for patching operations and which may be compacted when not in use.

It is important to note, however, that each of the foregoing systems requires a complex assembly system installed on a vehicle specially designed for road repair and asphalt distribution.

Infrared asphalt repair technology has become increasingly popular. One commercially available vehicle having an infrared heating device is marketed by Kasi Infrared, a division of R. Filion Manufacturing, Inc., and is described at http://www.kasiinfrared.com/. This website describes the following infrared restoration method for heating and applying asphalt to ground surfaces using an infrared heating device: sweep away loose debris or standing water from repair and surrounding area; light the heating chamber and position it over the area to be repaired allowing at least 12" of heated area beyond the perimeter of the repair; allow heat to penetrate for 7-10 minutes while checking surface temperature of the asphalt every 7 minutes; remove the heater and rake the softened asphalt; spray a substance on the heated area to replace some of the oil which has dissipated over time; apply fresh asphalt; and use a vibratory roller to compress the asphalt.

Infrared technology is viewed in the art as a superior form of asphalt repair. This technology avoids seams where the hot asphalt meets the cold pavement which allow water to penetrate the repair, causing the repaired filled-in portions to fail, typically within a year or so. Infrared technology blends new asphalt in with the original asphalt by heating an area 6 to 8 inches beyond the perimeter of the repair; the new asphalt is then compacted with the old creating a seamless permanent restoration.

A significant limitation, however, in using infrared technology has been the maneuverability and large size of the trucks that carry the systems. As a result, these trucks often cannot be used in tight spaces, close to buildings and other obstructions, and in other hard to reach areas. Small "walk behind" infrared heaters which are pushed by the user are available, but because of the smaller heater surface area, they take significantly longer to heat the asphalt and make the necessary repairs.

One particular limitation of infrared restoration vehicles with infrared heating devices attached is the difficulty of backing up the truck with the device in the lowered position. It is very difficult for the driver of the truck to judge how close the edge of the lowered infrared heating device is to a wall, garage door or other structure. Generally, backing up a truck with a lowered, mounted infrared heating device requires a human "spotter" to guide the person driving the truck. The spotter must let the driver know how close the extended infrared heating device is to the wall.

A further disadvantage of current technology mounted to vehicles is that as each area is repaired using an infrared, a "patchwork effect" is created, because it is difficult to see behind a vehicle to align each repair area.

It is desirable to have a method for using an infrared heating device for asphalt repair that does not require a spotter, because the spotter is needed to perform other necessary labor (e.g., raking or leveling), and which allows the spotter to devote their time and labor to quickly raking and leveling the previously heated areas.

It is aesthetically desirable to have an infrared heater mounting device that allows successive, symmetrical alignment of areas that are in a straight row and which need to be heated to avoid a "patchwork effect."

It is desirable to be able to maneuver an infrared heating device around and close to a variety of structures (e.g., electrical boxes, walls, garage doors, protective poles and vehicle obstacles such as, tollbooths, monuments, fountains, curbs, etc.) The asphalt surrounding many of these structures is particularly susceptible.

It is further desirable to have a device which may be inexpensively manufactured and sold to adapt existing asphalt trucks or utility vehicles with infrared heaters resulting in increased maneuverability and mobility for positioning and patching of asphalt surfaces.

SUMMARY OF THE INVENTION

A telescoping device for a road repair vehicle which allows an infrared heating chamber to be moved forward and backward without the need to move the vehicle. An infrared chamber mounting apparatus and attachment structure are attached to an infrared heating chamber. The attachment structure consists of metal loops, a support pipe and a horizontal support bar. Connected to the support bar are interior tubular components. A hydraulic cylinder is connected to the support bar and is used to move interior tubular components which pass inside exterior tubular components welded to the vehicle frame. Moving the interior and exterior tubular components in relation to each other adjusts the distance between the infrared heating chamber and the vehicle. In alternate embodiments, a pivotal mounting structure and/or a rack and pinion mechanism are inserted allowing the infrared heating chamber to be moved sideways or at an angle, respectively.

DETAILED DESCRIPTION OF EMBODIMENTS OF THE INVENTION

For the purpose of promoting an understanding of the present invention, references are made in the text hereof to embodiments of a device for a road repair vehicle, only some of which are described herein. It should be understood, nevertheless, that no limitations on the scope of the invention are thereby intended. One of ordinary skill in the art will readily appreciate that modifications such as the dimensions, size, and shape of the components, alternate but functionally similar locations, and the inclusion of additional elements are deemed readily apparent and obvious to one of ordinary skill in the art; and all equivalent relationships to those illustrated in the drawings and described in the written description do not depart from the spirit and scope of the present invention. Some of these possible modifications are mentioned in the following descriptions. Therefore, specific details disclosed herein are not to be interpreted as limiting, but rather as a representative basis for teaching one of ordinary skill in the art to employ the present invention in virtually any appropriately detailed apparatus or manner.

It should be understood that the drawings are not necessarily to scale, emphasis instead being placed upon illustrating the principles of the invention. In addition, in the embodiments depicted herein, like reference numerals in the various drawings refer to identical or near identical structural elements.

Moreover, the term "substantially" or "approximately" as used herein may be applied to modify any quantitative representation that could permissibly vary without resulting in a change in the basic function to which it is related.

Referring now to the drawings, FIG. 1*a* shows a road repair vehicle 10 to which an infrared heating chamber 50 has been attached and is positioned in an upright position.

Figure 1B:
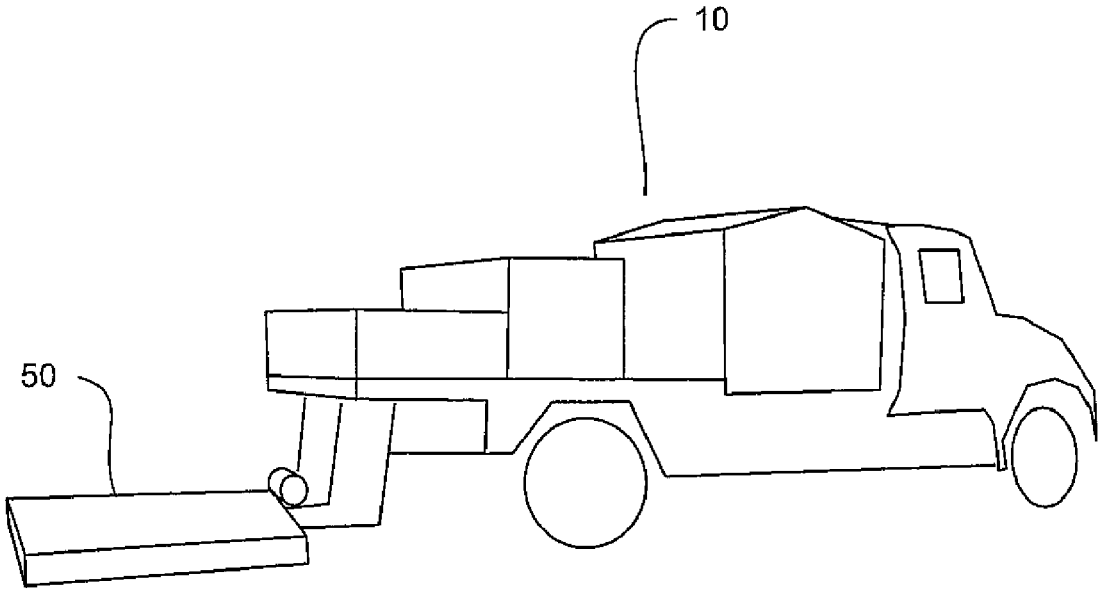
FIG. 1*b* shows an embodiment of a road repair vehicle with an infrared heating chamber in a lowered in-use position.

FIG. 1*b* shows a road repair vehicle 10 to which an infrared heating chamber 50 has been attached and is positioned in a lowered in-use position.

Figure 2A:
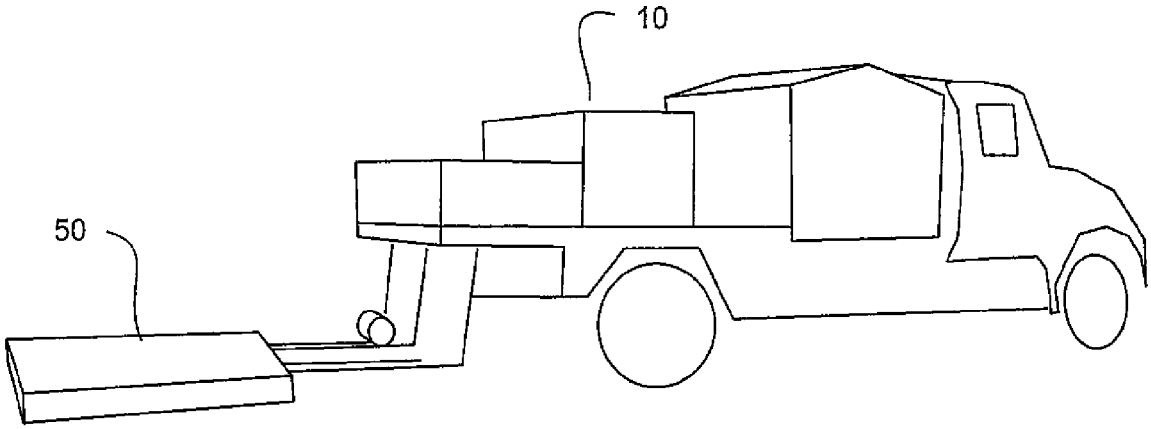
FIG. 2*a* shows an embodiment of a road repair vehicle with the mounting apparatus disclosed herein wherein the infrared heating chamber is positioned in a horizontally extended position.

FIG. 2*a* shows a road repair vehicle 10 with one embodiment of a mounting apparatus (not shown in detail) wherein the infrared heating chamber 50 is positioned in a horizontally extended position.

Figure 2B:
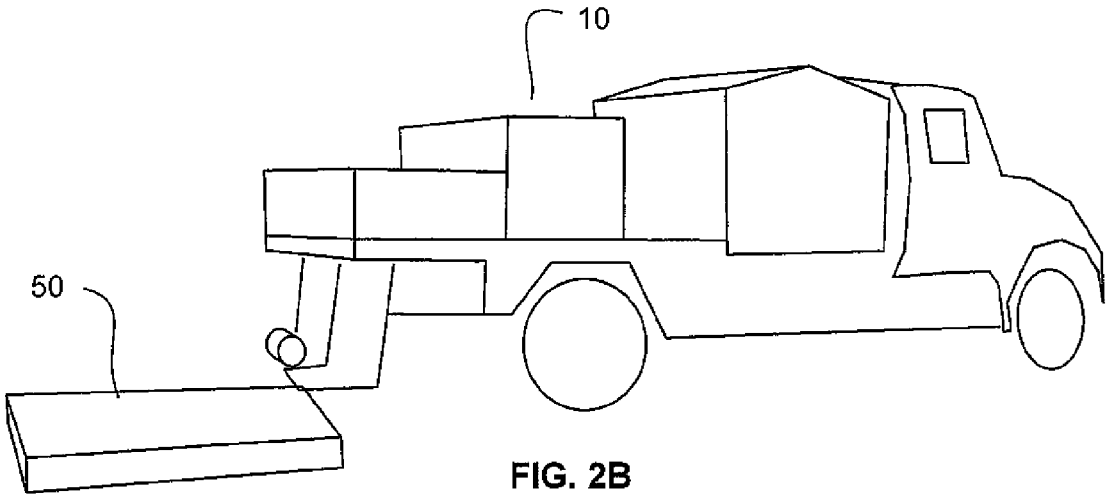
FIG. 2*b* shows an embodiment of a road repair vehicle with the mounting apparatus disclosed herein wherein the infrared heating chamber is positioned in an extended to the right of center position.

FIG. 2*b* shows a road repair vehicle 10 with an alternate embodiment of a mounting apparatus (not shown in detail) wherein the infrared heating chamber 50 is positioned in an extended to the right of center position.

Figure 2C:
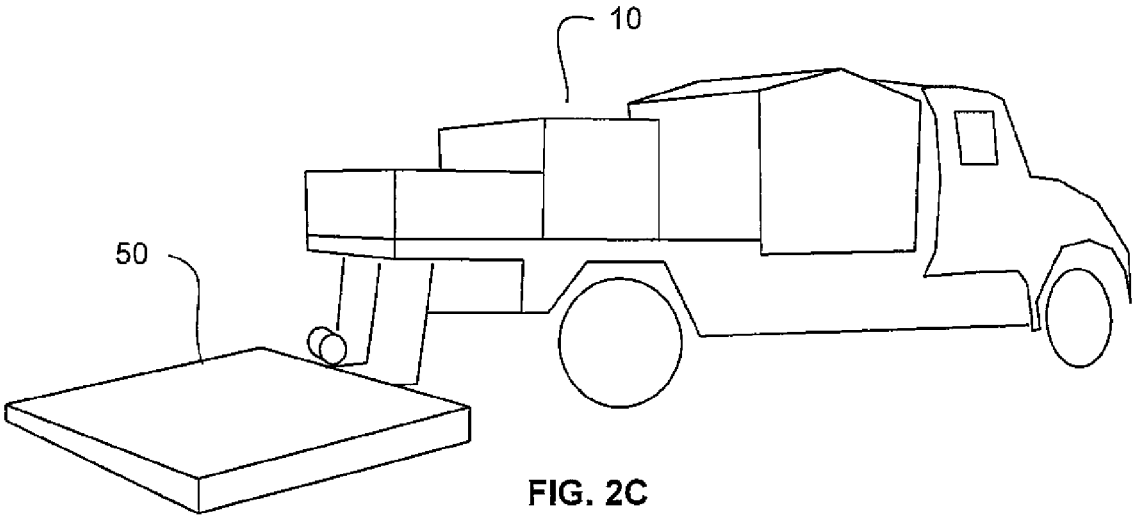
FIG. 2*c* shows an embodiment of a road repair vehicle with the mounting apparatus disclosed herein wherein the infrared heating chamber is positioned in a pivoted position.

FIG. 2*c* shows a road repair vehicle 10 with another alternate embodiment of a mounting apparatus (not shown in detail) wherein the infrared heating chamber 50 is positioned in a pivoted position.

Figure 3:
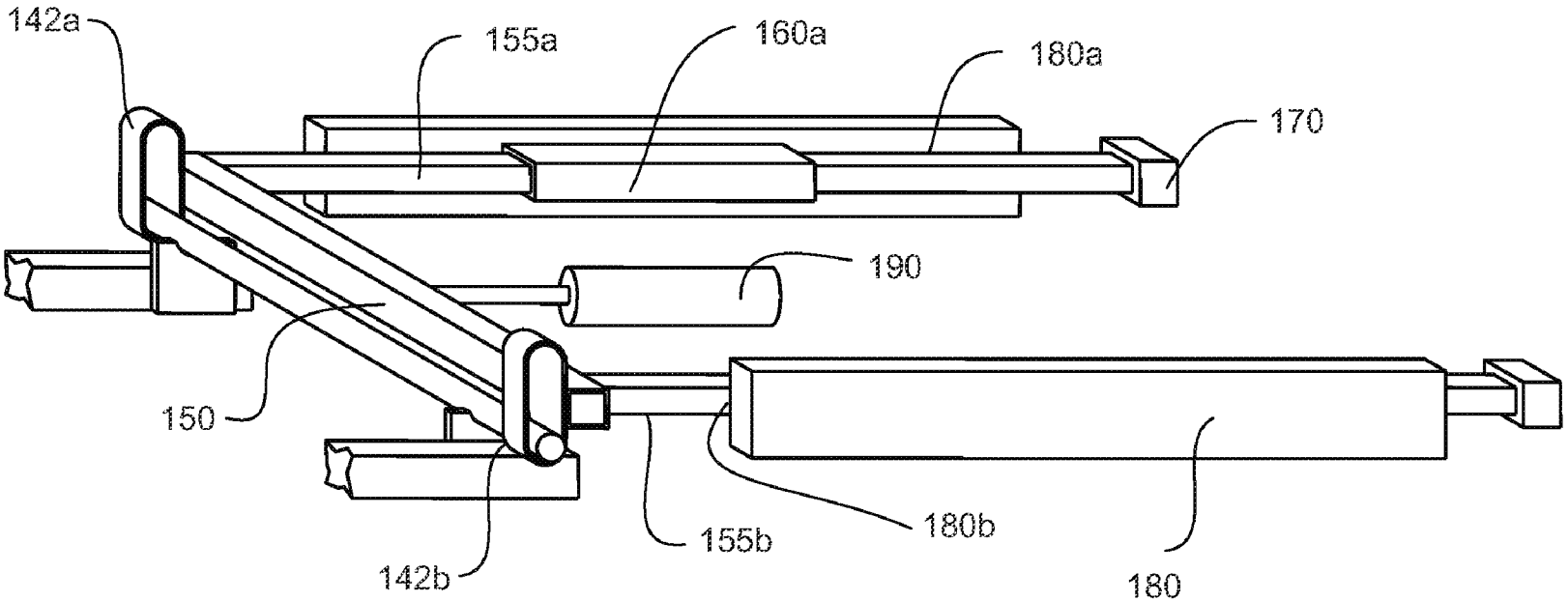
FIG. 3 shows a side perspective view of one embodiment of an infrared chamber mounting apparatus disclosed herein which extends in the horizontal position.

FIG. 3 shows one embodiment of an infrared heating chamber mounting apparatus attached to infrared heating chamber frame 100 which allows an infrared heating chamber 50 to be horizontally extended. In the embodiment shown, metal loops 142*a* and 142*b* on an infrared heating chamber frame are attached by welding, bolts, screws, linchpin or other functionally equivalent means near each end of a support pipe 115 wherein the support pipe 115 passes through the interior of metal loops 142*a* and 142*b*. In other embodiments, support pipe 115 may be connected to another part of a support frame of an infrared heating device, as is it is contemplated that not all commercially available infrared heating structures with support frames will have metal loops. In the embodiment shown, the support pipe 115 is round tubing, but in other embodiments may be square tubing, strips, other reinforcing material or any other structure which performs the equivalent function of support pipe 115.

As also illustrated in FIG. 3, Horizontal support bar 150 is attached to the exterior surface of metal loops 142*a* and 142*b* by welding, bolts, screws, linchpins or other structural attachment means known in the art. Telescoping member interior tubular components 156*a* and 156*b* are attached to the side of the horizontal support bar 150 opposite to the side to which metal loops 142*a* and 142*b* are attached. In the embodiment shown, the horizontal support bar 150 is welded to telescoping member interior tubular components 155*a* and 155*b*, but in other embodiments may be attached by bolts, screws, linchpins or other structural attachment means known in the art.

As shown in FIG. 3, telescoping member interior components 155*a* and 155*b* pass inside telescoping member exterior tubular components 160*a* and 160*b*. The telescoping member interior tubular components 155*a* and 156*b* are smaller in diameter and longer than the telescoping member exterior tubular components 160*a* and 160*b* allowing the interior tubular components 155*a* and 155*b* to pass inside the exterior tubular components 160*a* and 160*b*. In the embodiment shown, the telescoping member interior tubular components 155*a* and 155*b* and the exterior tubular components 160*a* and

160*b* are square tubing. In other embodiments, telescoping member tubular components may be round, rectangular or any other shape.

In the embodiment illustrated in FIG. 3, stop 170 is located at the end of the telescoping member interior tubular components 155*a* and 155*b* opposite the horizontal support bar 150. Stop 170 prevents the interior tubular components 155*a* and 155*b* from sliding out of the exterior tubular components 160*a* and 160*b*.

In the embodiment shown in FIG. 3, telescoping member exterior tubular components 160*a* and 160*b* are welded to a road repair vehicle frame 180 at attachment points 180*a* and 180*b* using any structural attachment components known in the art. In the embodiment shown, the road repair vehicle frame 180 is located outside the telescoping member exterior tubular components 160*a* and 160*b*. In other embodiments, the road repair vehicle frame 180 may be inside, above or below the exterior tubular components 160*a* and 160*b* and attachment points 180*a* and 180*b* located accordingly.

FIG. 3 further illustrates a hydraulic cylinder 190 fixedly attached to horizontal support bar 150. Other embodiments may include or omit hydraulic cylinder. In the embodiment shown, hydraulic cylinder 190 moves the horizontal support bar 150. Moving the horizontal support bar 150 also moves the interior tubular components 155*a* and 155*b*, which are welded to the horizontal support frame 150, and adjusts the location of the interior tubular components 155*a* and 155*b* in relation to the exterior tubular components 160*a* and 160*b*. This movement/adjustment of the interior tubular components 155*a* and 155*b* in relation to the exterior tubular components 160*a* and 160*b* allows the infrared heating chamber 50 (not shown) move forward and backward along a plane substantially horizontal to the asphalt to be heated without having to move the road repair vehicle 10.

Figure 4:
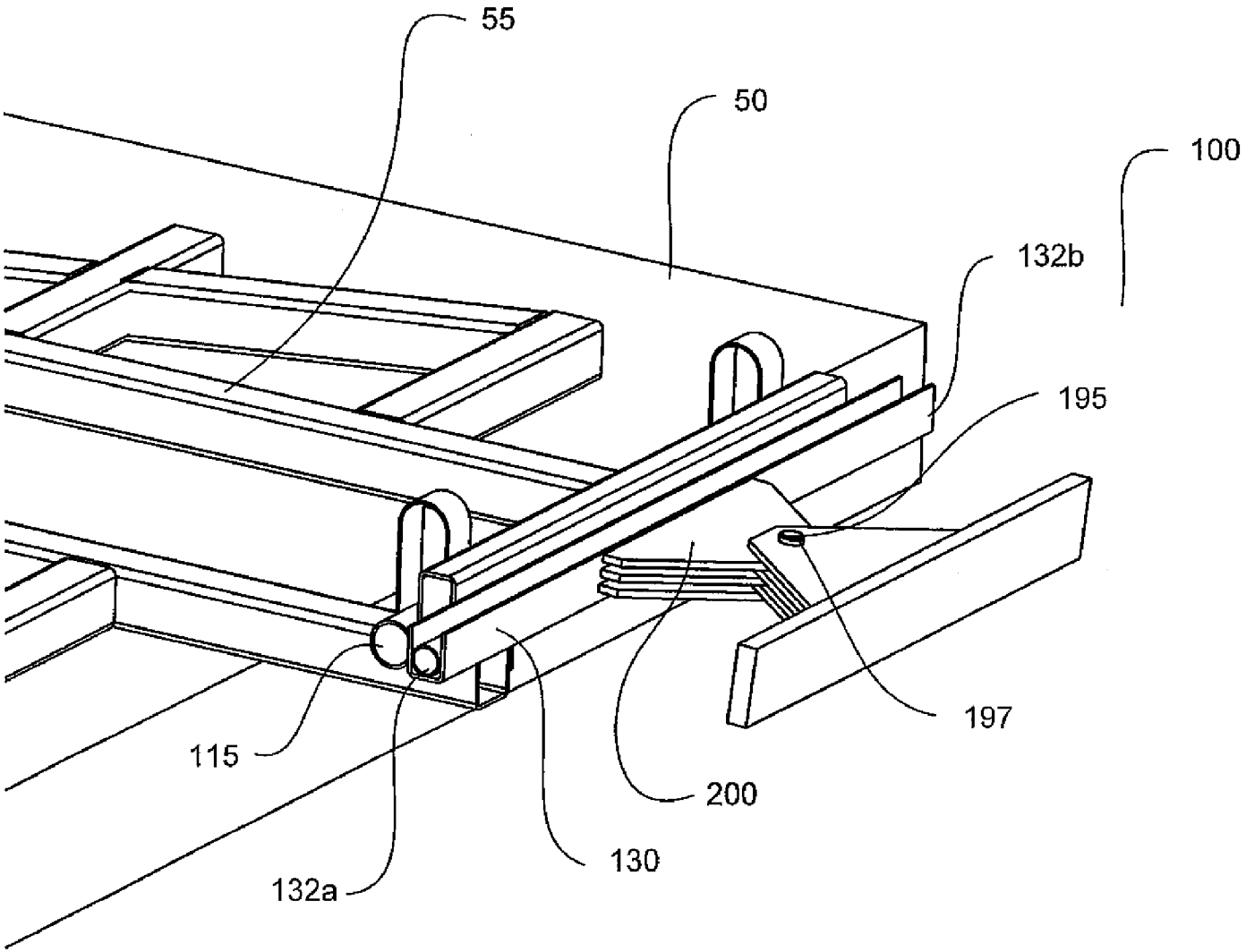
FIG. 4 shows a side perspective view of one embodiment of an infrared chamber mounting apparatus disclosed herein which pivots.

FIG. 4 shows an alternative embodiment of an infrared chamber mounting apparatus 100 having one or more pivotal mounting structures 200 and u-shaped sliding track component 130 which allow an infrared heating chamber 50 to be pivoted and moved from one side to the other. In the embodiment shown, U-shaped sliding track component 130 is attached to horizontal support bar 150 wherein the open side of the u-shaped sliding track component 130 is upward. One end of a pivotal mounting structure 200 is attached to the u-shaped sliding track component 130 opposite the side which is attached to horizontal support bar 150. In the embodiment shown, u-shaped sliding track component further includes one or more stops 132*a* and 132*b* which are any protuberance or structure which stops side-to-side movement of the infrared heating chamber so that it remains stably positioned within u-shaped sliding track 130.

In the embodiment shown in FIG. 4, pivotal mounting structure 200 controls and actuates the pivotal movement of support pipe 115 which is attached to a component of the support frame of the infrared heating chamber. The bottom side of u-shaped sliding track component 130 and horizontal support bar 150 are attached to an infrared heating chamber supporting frame 55 which is mounted on the topside of an infrared heating chamber 50. In the embodiment shown, all attachment points are welded, but in other embodiments one or more attachment points may be bolts, screws, linchpins or other structural attachment means known in the art.

In the embodiment shown, the pivotal mounting structure 200 is triangular with an aperture 195 into which a hinge pin 197 is inserted. The pivotal mounting structure 200, aperture 195 and hinge pin 197 allow the infrared chamber mounting apparatus 100 to be rotated at a maximum angle of 50 degrees. Other embodiments may include more or fewer pivotal mounting structures, as necessary, which may be of different shapes and dimensions (e.g., square, rectangular, circular or oval).

Various embodiments of infrared chamber mounting apparatus may include or omit pivotal mounting structure 200, or u-shaped sliding track component 130, or offer other components which alter, increase or decrease the range of motion afforded by pivotal mounting structure 200, or u-shaped sliding track component 130.

Figure 5:
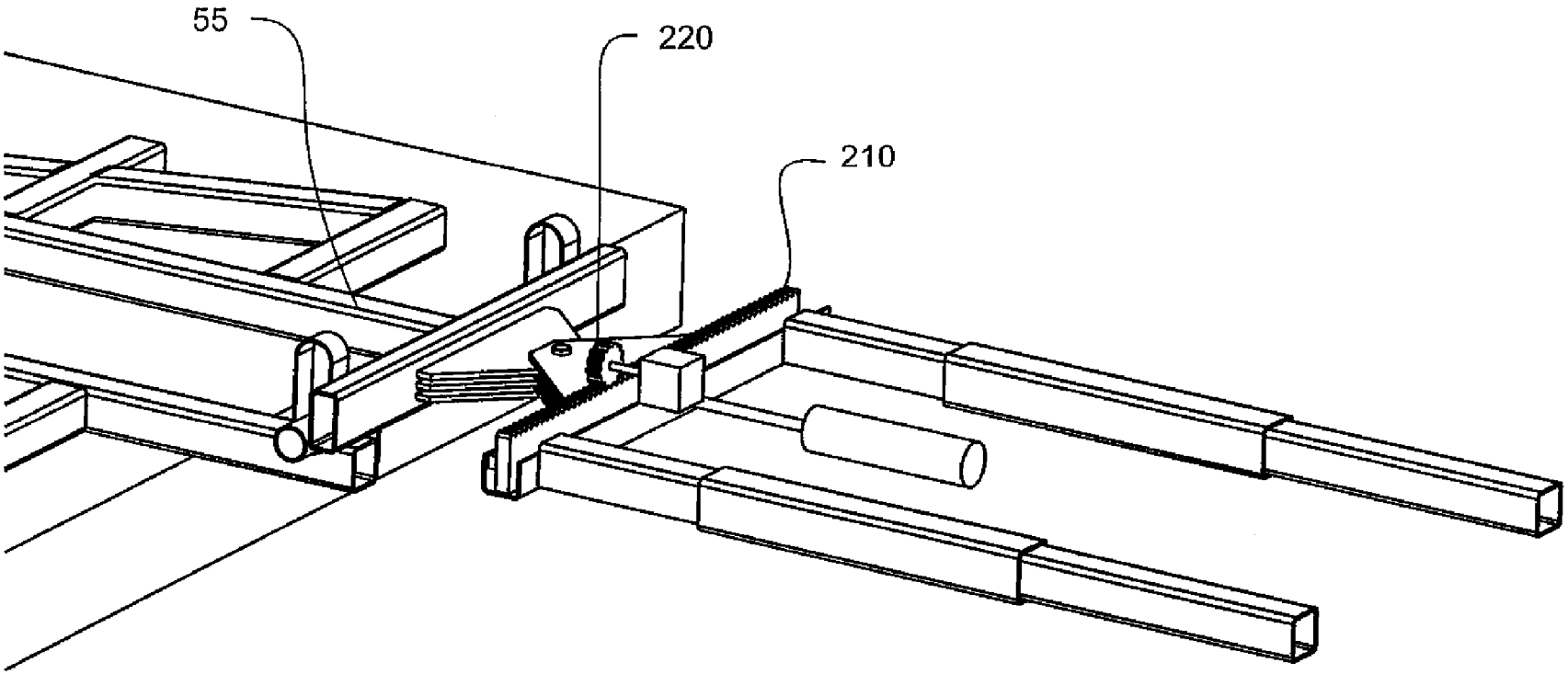
FIG. 5 shows a side perspective view of one embodiment of an infrared chamber mounting apparatus disclosed herein which horizontally extends, moves side-to-side and pivots.

FIG. 5 shows another alternate embodiment of an infrared chamber mounting apparatus 100 which allows an infrared heating chamber 50 to be extended horizontally, moved side-to-side and pivoted at an angle. In addition to the previous embodiments of infrared chamber mounting apparatus 100, this embodiment further comprises a rack 210 and pinion mechanism 220 allowing the infrared heating chamber 50 to be moved sideways along a plane substantially horizontal to the asphalt to be heated. In the embodiment shown, the rack 210 and pinion mechanism 220 is actuated by a 12 volt motor (not shown), but may be actuated by any suitable size motor.

What is claimed is:

1. A mounting apparatus providing three axes of movement for an infrared heating device comprising:

at least two loop attachment members fixedly attached to an infrared heating chamber frame;

a horizontal tubular support bar passing through and fixedly attached at either end to the interior of said at least two loop attachment members;

a horizontal structural support bar with two ends and a bottom side, wherein said horizontal structural support bar is fixedly attached at either end to the exterior of said at least two loop attachment members and said bottom end is adapted to be fixedly attached to said infrared heating chamber frame;

at least one telescoping member comprised of at least two telescoping member interior tubular components with an attached end, stopping end, first diameter and first length, each of said attached ends fixedly attached to either end of said horizontal structural support bar opposite to the side to which said at least two loop attachment members are fixedly attached, at least two stopping components with a third diameter, each of said at least two stopping components fixedly attached to said stopping ends of said at least two telescoping member interior tubular components, and at least two telescoping member exterior tubular components with a second diameter and a second length welded to a vehicle frame, wherein said first diameter is smaller than said second diameter, said third diameter is greater than said first and second diameters, and said first length is greater than said second length and wherein said at least two telescoping member interior tubular components are slidingly secured by said at least two telescoping member exterior tubular components so that said horizontal structural support bar is moveable along a horizontal axis at varying distances from the back of said vehicle and prevented from over-extending by said at least two stopping components;

at least one attachment component which fixedly attaches said at least two telescoping member exterior components to said vehicle frame;

a pivotal mounting structure comprised of a u-shaped sliding track component with a first vertical side, a second vertical side and a bottom side, wherein the exterior of said bottom side is adapted to be fixedly attached to said infrared heating chamber frame, at least one triangular plate component with an aperture, and a hinge pin adapted to pivotally secure said infrared heating chamber frame to said triangular plate component, wherein said first vertical side is fixedly attached to said horizontal structural support bar and said second vertical side is fixedly attached to said triangular plate component so that the open side of said u-shaped sliding track component is facing upwards; and a side-to-side movement facilitation component comprised of said u-shaped sliding track component, and said at least two sliding stops, each of said at least two sliding stops fixedly positioned at either end of said u-shaped sliding track component, wherein said u-shaped sliding track component is further adapted to allow said horizontal structural support bar to be moved along a horizontal plane relative to the back of said vehicle and relative to the passenger and driver sides of said vehicle and said at least two sliding stops are adapted to prevent said infrared heating chamber frame from becoming unstably positioned within said u-shaped sliding track component.

2. The mounting apparatus of claim 1 wherein said horizontal tubular support bar is a structure selected from a group consisting of a round pipe, a square pipe, a bar, an L-shaped unit comprising a support bar and platform, a platform, a plurality of attachment structures, and a rod.

3. The mounting apparatus of claim 1 which further includes a hydraulic cylinder which facilitates movement of said horizontal structural support bar and said at least two telescoping interior tubular components within said at least two telescoping member exterior tubular components.

4. The mounting apparatus of claim 1 wherein said hinge pin component is selected from a group consisting of a lynch pin, a bolt, a hinge, and a rod.

5. The mounting apparatus of claim 1 in which said u-shaped sliding component further includes a rack and pinion structure to allow said horizontal support bar to be moved along a horizontal plane relative to the back of the vehicle and relative to the passenger and driver sides of the vehicle using a rack and pinion mechanism.

6. The mounting apparatus of claim 1 which is powered by a motor to facilitate directional movement of said horizontal structural support bar, wherein said directional movement is selected from a group consisting of side-to-side movement, pivotal movement, and movement along a horizontal axis which varies the distance of said infrared heating chamber frame from said vehicle.

7. A mounting apparatus for an infrared heating device comprising:

at least two loop attachment members fixedly attached to an infrared heating chamber frame;

a horizontal tubular support bar adapted to pass through and be fixedly attached at either end to the interior of said at least two loop attachment members;

a horizontal structural support bar with two ends and a bottom side, wherein said horizontal structural support bar is fixedly attached at either end to the exterior of said at least two loop attachment members and said bottom end is adapted to be fixedly attached to said infrared heating chamber frame;

at least one telescoping member comprised of at least two telescoping member interior tubular components with an attached end, stopping end, first diameter and first length, each of said attached ends fixedly attached to either end of said horizontal structural support bar opposite to the side to which said at least two loop attachment members are fixedly attached, at least two stopping components with a third diameter, each of said at least two stopping components fixedly attached to said stopping ends of said at least two telescoping member interior tubular components, and at least two telescoping member exterior tubular components with a second diameter and a second length welded to a vehicle frame, wherein said first diameter is smaller than said second diameter, said third diameter is greater than said first and second diameters, and said first length is greater than said second length and wherein said at least two telescoping member interior tubular components are slidingly secured by said at least two telescoping member exterior tubular components so that said horizontal structural support bar is moveable along a horizontal axis at varying distances from the back of said vehicle and prevented from over-extending by said at least two stopping components;

at least one attachment component which fixedly attaches said at least two telescoping member exterior components to vehicle frame; and at least one pivotal mounting structure adapted to allow said horizontal structural support bar to be moved at an angle along a horizontal plane relative to the back of said vehicle, said at least one pivotal mounting structure comprising a u-shaped sliding track component with a first vertical side, a second vertical side, a bottom side and at least two sliding stops, wherein said bottom side is adapted to be fixedly attached to said infrared heating chamber frame, at least one angular plate component with an aperture, and a hinge pin adapted to pivotally secure said infrared heating chamber frame to said triangular plate component, wherein said first vertical side is fixedly attached to said horizontal structural support bar and said second vertical side is fixedly attached to said triangular plate component so that the open side of said u-shaped sliding track component is facing upwards.

8. The mounting apparatus of claim 7 in which said u-shaped sliding track component is adapted to allow said horizontal structural support bar to be moved along a horizontal plane relative to the back of said vehicle and relative to the passenger and driver sides of said vehicle, and which further includes at least one stop.

9. The mounting apparatus of claim 8 in which said u-shaped sliding track component is adapted to allow said horizontal structural support bar to be moved along a horizontal plane relative to the back of the vehicle relative to the passenger and driver sides of the vehicle, and which utilizes a rack and pinion mechanism.

10. The mounting apparatus of claim 7 wherein said pivotal mounting structure consists of a plurality of plates which are structurally arranged for support.

* * * * *